US005366355A

United States Patent [19]

Patterson

[11] Patent Number: 5,366,355

[45] Date of Patent: Nov. 22, 1994

[54] POSITIVE DISPLACEMENT PUMP

[76] Inventor: Douglas T. Patterson, 750 Tall Oaks Dr., Apt. 12100 I, Blacksburg, Va. 24060

[21] Appl. No.: 149,899

[22] Filed: Nov. 10, 1993

[51] Int. Cl.[5] ..... F01C 21/16

[52] U.S. Cl. ..... 418/32; 418/160; 417/315

[58] Field of Search ..... 417/315, 461; 418/32, 418/160, 186, 188, 209

[56] References Cited

U.S. PATENT DOCUMENTS 1,850,567 3/1932 Roessler ..... 418/32
2,260,867 10/1941 Rappl ..... 418/160 X
2,260,868 10/1941 Rappl ..... 418/160 X
2,313,239 3/1943 Horton ..... 418/160 X
2,829,602 4/1958 Witchger ..... 418/32

FOREIGN PATENT DOCUMENTS 973930 11/1982 U.S.S.R. ..... 418/32

*Primary Examiner*—Richard E. Gluck

[57] ABSTRACT

A rotor rides on the shaft end and is eccentric with respect to the rotational axis of the shaft. The rotor rotates in the bore of a pivot ring and coacts therewith in the nature of a double action pumping such that there are two pumping cycles per revolution of the shaft.

10 Claims, 3 Drawing Sheets

POSITIVE DISPLACEMENT PUMP

BACKGROUND OF THE INVENTION

Fluid machines such as compressors are typically lubricated by oil drawn from a sump by a pumping structure associated with the crankshaft. Centrifugal pumps and positive displacement pumps such as gerotors are commonly used to pump the oil. One problem associated with some rotary compressors such as scroll compressors is that they can run in reverse due to miswiring or due to a pressure equalization across the compressor upon shut down. Under these conditions some types of oil pumps do not function properly and damage can result from lack of adequate lubrication. Those oil pumps that do function properly under reverse rotation conditions are, typically, relatively complicated and costly.

SUMMARY OF THE INVENTION

A positive displacement pump is driven by the shaft through a pin which coacts with a slot in an eccentric rotor. For either direction of rotation, the pin coacting with the slot causes the eccentric rotor to be properly positioned relative to the fluid passages to permit pumping of oil in one direction.

It is an object of this invention to provide a positive displacement oil pump having few parts, low cost and high reliability.

It is a further object of this invention to provide a positive displacement oil pump suitable for horizontal and vertical compressors.

It is another object of this invention to provide a pump which pumps fluid in one direction independent of the direction of shaft rotation. These objects, and others as will become apparent hereinafter, are provided according to the teachings of the present invention.

Basically, an eccentric rotor is received on a shaft end and surrounded by a pivot ring which pivots about a fixed point. An end cap coacts with the shaft end to hold the rotor and pivot ring in place. A pin fixed in the shaft end coacts with a slot in the rotor to position the rotor in accordance with the direction of rotation of the shaft.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
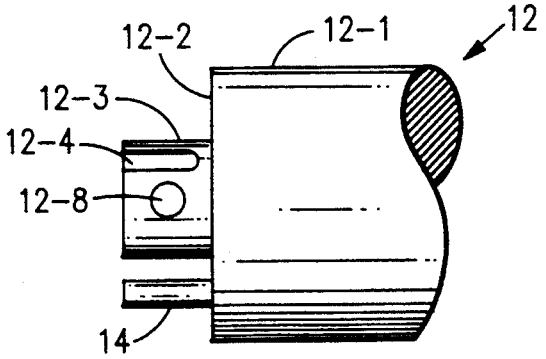
FIG. 1 is a side view of the shaft end.
Figure 2:
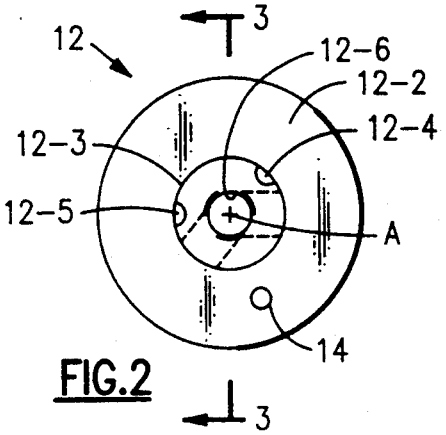
FIG. 2 is an end view of the shaft end of FIG. 1.
Figure 3:
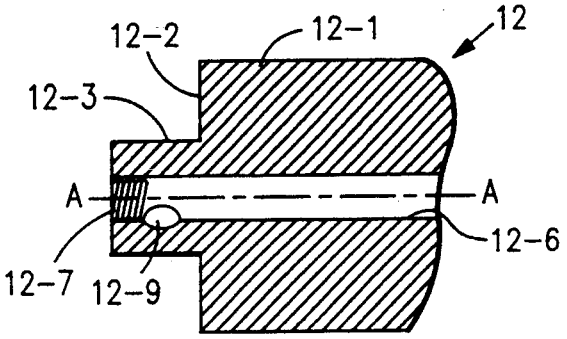
FIG. 3 is a sectional view taken along 3—3 of FIG. 2.

In the Figures, the numeral 12 generally designates the shaft of a fluid machine such as a scroll compressor. As best shown in FIGS. 1–3, shaft 12 has a first portion 12-1 and a cylindrical, reduced diameter shaft end 12-3 separated from the first portion by shoulder 12-2. Drive pin 14 is received in a bore in shaft 12 and axially extends from shoulder 12-2. Axially extending grooves 12-4 and 12-5 are formed in the surface of shaft end 12-3 and form part of the oil feed structure. Bore 12-6, which has a threaded portion 12-7, is supplied by the pump structure via radial passage 12-8 or 12-9, depending upon the direction of rotation of shaft 12, and supplies oil to the bearings etc. (not illustrated) requiring lubrication. A-A is the axis of bore 12-6 and shaft 12.

Figure 4:
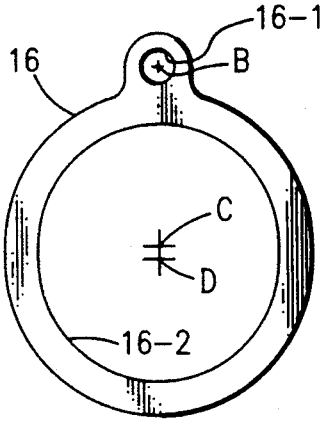
FIG. 4 is an end view of the pivot ring.
Figure 5:
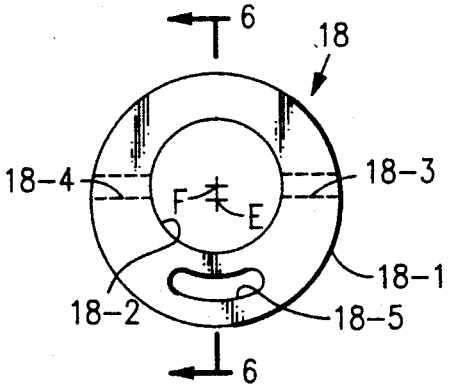
FIG. 5 is an end view of the eccentric rotor.
Figure 6:
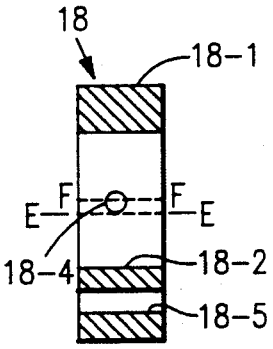
FIG. 6 is a sectional view taken along 6—6 of FIG. 5.
Figure 7:
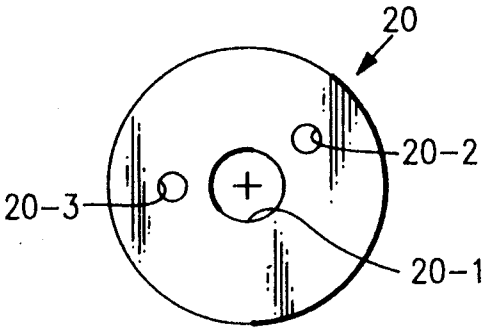
FIG. 7 is an end view of the end cap.

Referring now to FIG. 4, the numeral 16 designates the pivot ring. Pivot ring 16 has a bore 16-1 with an axis, appearing as point B, about which pivot ring 16 pivots. Pivot ring 16 has a second bore 16-2 which is made up of two 180° semi-circular portions centered on axes represented by points C and D, respectively, and joined by two straight segments equal to the separation of C and D. As best shown in FIGS. 5 and 6, eccentric rotor 18 has an outer cylindrical surface 18-1 centered on E and of a diameter nearly equal to that of the semi circular portions of bore 16-2 whereby rotor 18 is received in bore 16-2 with a slip fit a with sealing contact. Circular bore 18-2 is formed in rotor 18 and has a center F which is spaced from E the same distance as the spacing of C and D. Rotor 18 has a diametrical bore, intersecting bore 18-2, made up of two segments, 18-3 and 18-4, respectively. Arcuate slot 18-5 is formed in rotor 18 and receives drive pin 14. As best shown in FIG. 7, end cap 20 has a central bore 20-1 and two bores, 20-2 and 20-3, which register with grooves 12-4 and 12-5, respectively.

Figure 8:
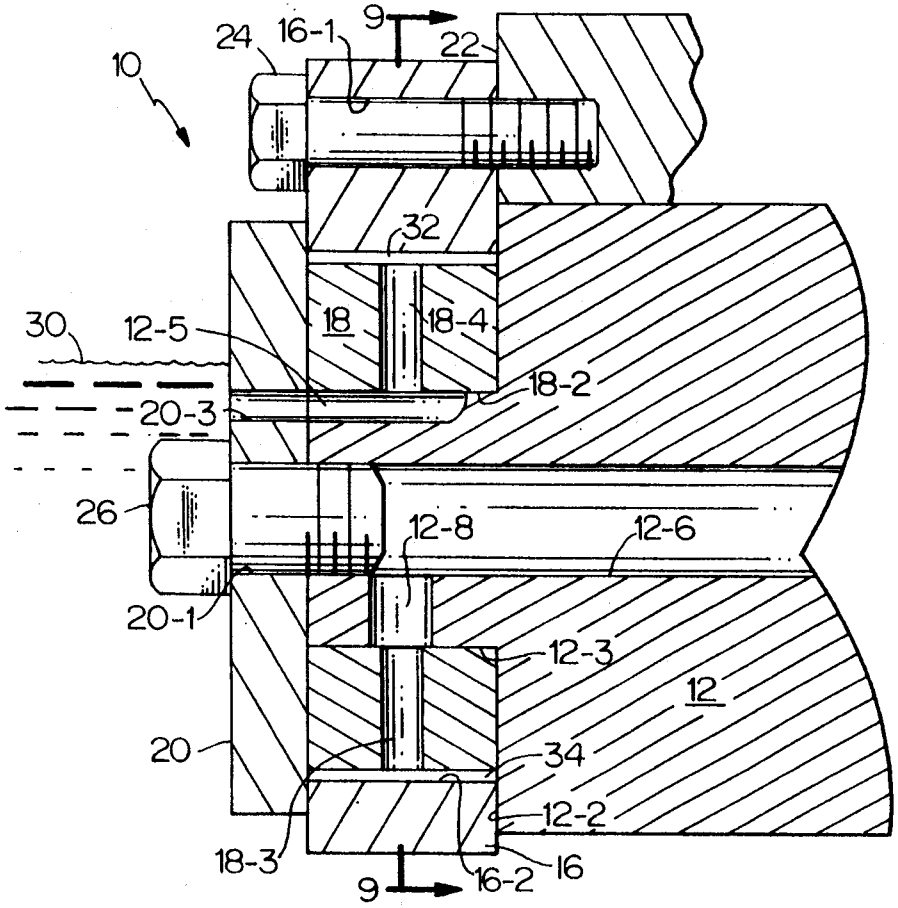
FIG. 8 is a sectional view of the assembly.
Figure 9A:
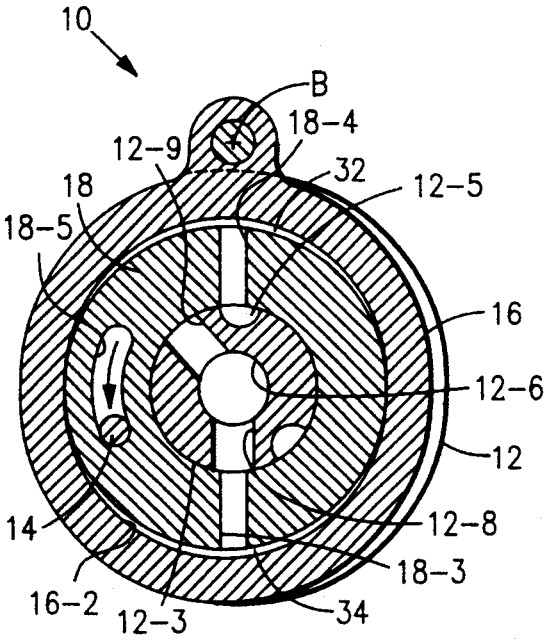
FIGS. 9 A–D are sectional views taken along line 9—9 of FIG. 8 at 90° intervals of the rotation of the shaft with FIG. 9A corresponding exactly to FIG. 8.

The assembled pump assembly 10 is best shown in FIGS. 8 and 9A. Shaft end 12-3 is surrounded by rotor 18 which is received in bore 16-2 of pivot ring 16 such that drive pin 14 is located in slot 18-5 and bore 16-2 acts as a cylinder or piston chamber for rotor 18 which acts as a piston. Pivoted ring 16 is suitably pivotably secured to a pump end bearing, or the like 22 as by bolt 24. Alternatively, a pin pressed into bearing 22 with a slip fit and extending into bore 16-1 may provide a pivot for ring 16. End cap 20 is properly located with respect to shaft 12, as by dowel pins or assembly fixtures (not illustrated) such that bores 20-2 and 20-3 register with grooves 12-4 and 12-5, respectively. Bolt 26 is received in bore 20-1 and threaded into threaded portion 12-7 of bore 12-6 such that rotor 18 and pivot ring 16 are secured between shoulder 12-2 and end cap 20 and coact to define the suction and discharge chambers. Thus, rotor 18, which rides on shaft end 12-3, is made eccentric with respect to the rotational axis, A-A, of shaft 12. This can be accomplished by offsetting the axis, F-F, of the bore 18-2 in rotor 18, from axis E-E, as illustrated, or by making the shaft end 12-3 on which it rides eccentric to axis A-A of shaft 12 by the same amount. Shaft 12 is machined such that shaft end 12-3 slip fits into the bore 18-2 of rotor 18. Shoulder 12-2 should be larger than the diameter of bore 16-2 of pivot ring 16 to seal off the shaft side of pump assembly 10. If it is not, a suitable ring, or the like, would be affixed to shaft 12 to provide this seal. Pivot ring 16 pivots on bolt 24 which is rigidly affixed relative to the pump housing. Ring 16 must be free to pivot due to the eccentricity of the rotor 18.

Alternatively, ring 16 could be flat on two opposite outer sides and reciprocate inside a housing rather than pivoting, as is the case with a slider block.

In FIG. 8, which corresponds to FIG. 9A, oil from sump 30 passes via bore 20-3, groove 12-5 and bore 18-4 into chamber 32 which is functioning as a suction chamber. Oil in chamber 34, which is functioning as a discharge chamber, is pumped via bore 18-3 and bore 12-8 into bore 12-6 from which it passes to the bearings, etc. requiring lubrication.

Referring now to FIGS. 9 A–D which represent 90° intervals of the rotation of shaft 12 it will be initially noted that drive pin 14 is at one extreme of slot 18-5, specifically the counterclockwise extreme in FIGS. 9 A–D. The illustrated counterclockwise rotation of shaft 12 causes drive pin 14 to rotate therewith engaging the counterclockwise end of slot 18-5 and driving eccentric rotor 18 in a counterclockwise direction. Because the axis E-E of outer cylindrical surface 18-1 is eccentric relative to axis F-F of bore 18-2 which is, in turn, coaxial with axis A-A of shaft 12 rotor 18 effectively reciprocates in bore 16-2 in a double action pumping accommodated by the pivoting of ring 16. This produces two pumping cycles per revolution of shaft 12.

Figure 9D:
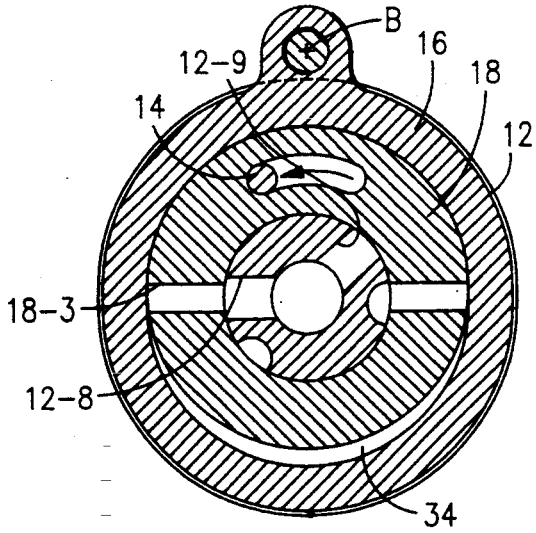
Figure 9B:
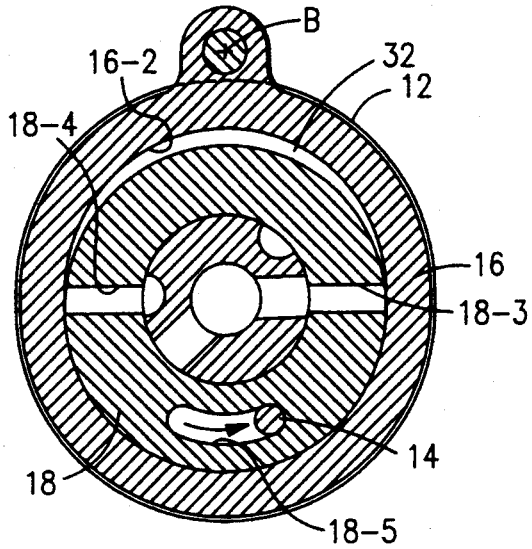
Figure 9C:
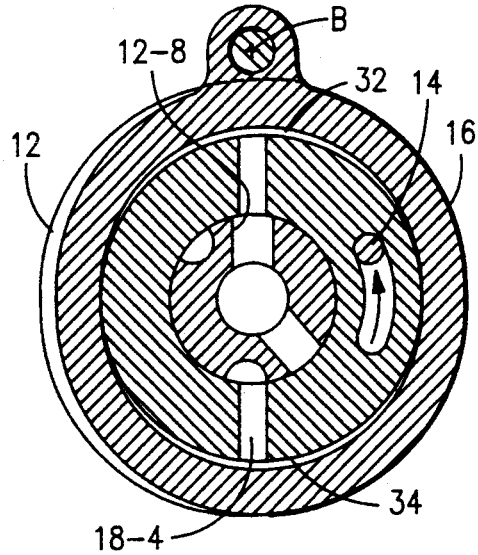

As described with respect to FIG. 8, FIG. 9A represents simultaneous suction and discharge strokes. Oil from sump 30 is supplied via groove 12-5 and bore 18-4 to chamber 32 while oil in chamber 34 is pumped via bore 18-3 and bore 12-8 to bore 12-6 from which it passes to the bearings, etc. Relative to FIG. 9A, FIG. 9B represents the completion of the suction and discharge processes taking place in FIG. 9A. It will be noted that bores 18-3 and 18-4 are effectively blocked by the walls of bore 16-2. Further counterclockwise rotation of shaft 12 and rotor 18 from the FIG. 9B position will establish communication between the trapped volume defined by chamber 32 and bore 18-3 permitting the discharge of the oil in trapped volume 32 via bore 18-3, bore 12-8 and bore 12-6 for distribution to the parts requiring lubrication. FIG. 9C is like FIG. 9A except for the reversing of the functions of chamber 32 and chamber 34 which function as suction and discharge chambers, respectively. FIG. 9D, like FIG. 9B, represents the completion of the suction and discharge processes but for FIG. 9C, not FIG. 9A, and the trapped volume defined by chamber 34 will be communicated with bore 18-3 and discharged upon further counterclockwise rotation.

Figure 10:
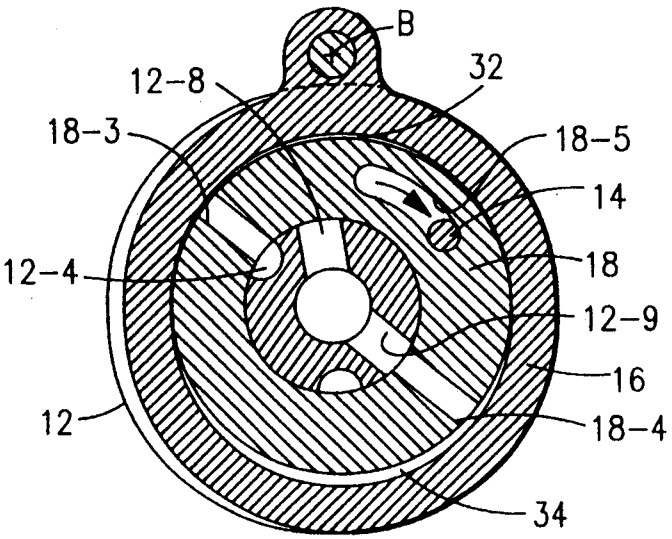
FIG. 10 represents a position corresponding generally to that of FIG. 9C under conditions of reverse rotation.

A major advantage of the present invention is its operation upon reverse rotation of shaft 12. FIG. 10 illustrates a position of reverse, clockwise, rotation. Upon clockwise rotation of shaft 12, pin 14 engages the clockwise end of slot 18-5 causing clockwise rotation of rotor 18. Under the conditions of clockwise rotation, as compared to counterclockwise rotation, bore 20-2 and groove 12-4 become the suction path and bore 18-4, bore 12-9 and bore 12-6 become the discharge path. Also, because slot 18-5 is about 45° in extent, the annular positions of the parts are different. Specifically comparing FIGS. 9C and 10 will locate pin 14 and bores 12-8 and 12-9 in the same positions but bores 18-3 and 18-4 are shifted 45° and FIG. 10 is in an earlier stage of suction/discharge, i.e. it is about midway between FIGS. 9D and A in the cycle. Otherwise, pump assembly 10 will function the same in either direction of rotation.

Although a preferred embodiment of the present invention has been illustrated and described, other changes will occur to those skilled in the art. For example, the Figures have been specific to a horizontal orientation of the compressor, but the present invention is suitable for vertical compressors also. Additionally, the pump need not be carried by a reduced diameter portion of the shaft 12, instead, bearing 22 can be enlarged to perform the function of shoulder 12-2. Also, grooves 12-4 and 12-5 may communicate with oil supply structure such as an annulus formed in bearing 22 and fed from a sump or oil supply, rather than communicating directly with the oil sump 30 via bores 20-2 and 20-3. Slot 18-5 need not be arcuate and could be replaced with a notch. It is therefore intended that the scope of the present invention is to be limited only by the scope of the appended claims.

What is claimed is:

1. A positive displacement pump for a fluid machine having an oil supply comprising:

a shaft having a rotational axis and including oil distribution means;

rotor means drivingly received on said shaft and located eccentrically with respect to said rotational axis;

means defining a cylinder which receives said rotor means;

said means defining a cylinder pivoting about a fixed point and having a bore defined by a pair of semicircular portions joined by straight sections corresponding in extent to a distance by which said rotor means is located eccentrically with respect to said rotational axis;

means for supplying oil from said oil supply to said cylinder;

means for delivering oil from said cylinder to said oil distribution means;

said rotor means and said bore coacting to define at least one trapped volume and said shaft and rotor means having means for supplying oil from said oil supply to said trapped volume during a suction stroke and for supplying oil from said trapped volume to said oil distribution means during a discharge stroke;

said shaft having a limited rotational movement with respect to said rotor means and said means for supplying oil and said means for delivering oil each including a pair of alternative flow paths whereby said pair of alternative flow paths for supplying oil from said oil supply to said trapped volume during a suction stroke and said pair of alternative flow paths for supplying oil from said trapped volume to said oil distribution means during a discharge stroke reverse function between paths of said pairs of alternative paths upon reverse rotation of said shaft;

whereby said rotor coacts with said cylinder to draw oil from said oil supply and to pump said oil into said oil distribution means.

2. The pump of claim 1 wherein two pumping cycles take place for each revolution of said shaft.

3. A positive displacement pump for a fluid machine having an oil supply comprising:

a shaft having a rotational axis and oil supply and distribution means;

rotor means drivingly received on said shaft and located eccentrically with respect to said rotational axis;

means defining a cylinder having a bore defined by a pair of semicircular portions joined by straight sections corresponding in extent to a distance by which said rotor means is located eccentrically with respect to said rotational axis, said bore receiving said rotor means and coacting therewith to define at least one trapped volume;

oil passage means in said rotor means coacting with said oil supply and distributing means to supply oil from said oil supply to said trapped volume during a suction stroke and from said trapped volume to said oil distribution means during a discharge stroke;

said shaft having a limited rotational movement with respect to said rotor means and said means for supplying oil and said means for delivering oil each including a pair of alternative flow paths whereby said pair of alternative flow paths for supplying oil from said oil supply to said trapped volume during a suction stroke and said pair of alternative flow paths for supplying oil from said trapped volume to said oil distribution means during a discharge stroke reverse function between paths of said pairs of alternative paths upon reverse rotation of said shaft.

4. The pump of claim 3 wherein said rotor means is drivingly received via a coaction between a slot in said rotor means and a pin carried by said shaft.

5. The pump of claim 3 wherein said rotor means has an eccentrically located bore which receives said shaft.

6. The pump of claim 5 wherein said oil passage means in said rotor means includes a pair of radially extending bores.

7. The pump of claim 3 wherein said means defining a cylinder pivots about a fixed point responsive to rotation of said rotor means.

8. The pump of claim 3 wherein said oil supply means includes axial grooves in said shaft.

9. The pump of claim 3 wherein said oil distribution means includes radially extending bores in said shaft.

10. The pump of claim 3 wherein said rotor means is drivingly received via a coaction between a slot in said rotor means and a pin carried by said shaft which provides said limited rotational movement.

* * * * *

UNITED STATES PATENT AND TRADEMARK OFFICE

CERTIFICATE OF CORRECTION

PATENT NO. : 5,366,355

DATED : November 22, 1994

INVENTOR(S) : Douglas T. Patterson

It is certified that error appears in the above-identified patent and that said Letters Patent is hereby corrected as shown below:

On the title page, item

—(73) Assignee: Carrier Corporation
Syracuse, New York

Signed and Sealed this

Fourth Day of April, 1995

Bruce Lehman

*Attest:*

BRUCE LEHMAN

*Attesting Officer*

*Commissioner of Patents and Trademarks*